United States Patent [19]

Rajendren

[11] Patent Number: 4,844,843

[45] Date of Patent: Jul. 4, 1989

[54] WASTE WATER AERATOR HAVING ROTATING COMPRESSION BLADES

[76] Inventor: Richard B. Rajendren, 1013 Park La., Bell Plaine, Minn. 56011

[21] Appl. No.: 116,258

[22] Filed: Nov. 2, 1987

[51] Int. Cl.[4] ..... B01F 3/04

[52] U.S. Cl. ..... 261/30; 261/87

[58] Field of Search ..... 261/87, 30

[56] References Cited

U.S. PATENT DOCUMENTS

| | | | |
|---|---|---|---|
| 616,997 | 1/1899 | Whitney | 261/87 |
| 1,374,446 | 4/1921 | Greenawalt | 261/87 |
| 1,445,935 | 2/1923 | Daman et al. | 261/87 |
| 2,928,661 | 3/1960 | MacLaren | 261/87 |
| 3,092,678 | 6/1963 | Braun | 261/87 |
| 3,327,851 | 6/1967 | Anderson | 261/87 |
| 3,775,307 | 11/1973 | McWhirter et al. | 261/87 |
| 3,778,233 | 12/1973 | Blough et al. | 261/87 |
| 4,308,221 | 12/1981 | Durda | 261/87 |

FOREIGN PATENT DOCUMENTS

| | | | |
|---|---|---|---|
| 1242159 | 6/1967 | Fed. Rep. of Germany | 261/87 |
| 718372 | 3/1980 | U.S.S.R. | 261/87 |

*Primary Examiner*—Tim Miles

*Attorney, Agent, or Firm*—Moore & Hansen

[57] ABSTRACT

An aerator of this invention comprised of a housing, a motor driven cylindrical tube having an open distal end extending through the housing, and propeller blades attached to the distal end of the cylindrical tube. The surrounding ambient air enters the housing and is compressed by pairs of opposing compression blades located therein, with the compressed air being drawn through inlet slots into a central conduit formed by the cylindrical tube, and injected into the water through the open distal end thereof. The aerator may also have optional feed vanes to direct the compressed air through the inlet slots, and fixed fins to redirect the flow of the water past the propeller blades.

17 Claims, 5 Drawing Sheets

WASTE WATER AERATOR HAVING ROTATING COMPRESSION BLADES

BACKGROUND OF THE INVENTION

This invention relates generally to devices for mixing gases with fluids and for simultaneously agitating those fluids, and particularly to a device for aerating waste water in sewage treatment reservoirs and settling ponds.

The underlying principles involved in waste water aeration have been adequately explained in U.S. Pat. Nos. 4,240,990; 4,280,911; and 4,308,221. When aerating waste water to neutralize pollutants and promote the growth of those aerobic bacteria necessary for certain purification treatment methods or composting operations, there are two general goals. The first is to introduce the maximum amount of oxygen into the liquid that can be achieved. It is thus favorable to introduce the oxygen in the form of discrete bubbles of minimal size which will increase the diffusion rate and oxygen transfer efficiency for a given aerator. The second goal is to agitate the liquid, particularly at the point of oxygen injection. Complete agitation ensures that maximum gas diffusion and oxygen transfer will be achieved, since agitation both increases the number of discrete gas bubbles present at the point of injection and the flow rate of liquid through the area surrounding that point.

Devices which aerate and agitate stagnant waste water in water treatment ponds or reservoirs are conventionally mounted on a shoreline embankment, dock, or within a treatment facility building. The devices are commonly comprised of a motor drive unit, or power head which is situated above the water line, and a hollow drive or impeller shaft which also serves as a gas conduit which extends angularly downward below the surface of the water.

U.S. Pat. Nos. 4,240,990; 4,280,911; and 4,308,221 disclose an apparatus in which a shaft driven propeller coupled to a motor is mounted within a vortex shield at the distal end of the aerator. The drive shaft itself contains a hollow interior tube which terminates in an open end near just below the propeller. As the propeller is rotated at high speeds, the water is agitated and expelled outwardly through the vortex shield. The flowing water produces a slight vacuum or venturi effect which draws air into the hollow interior tube through inlet slots located near the drive motor, with that air being expelled into the agitated water from the distal end of the hollow interior tube.

These patents also disclose the use of a plurality of plates or vanes situated adjacent to the open distal end of the hollow interior tube opposite the propeller blades which function to break the bubbles of gas being expelled from the hollow interior tube into smaller, finely divided bubbles. These more discrete bubbles serve to lower the dependence on "hang time" for dissolving the oxygen into the water by increasing the total aggregate surface area of the multitude of singular bubbles, thereby increasing the oxygen transport interface.

U.S. Pat. Nos. 3,782,702 and 4,448,685 each disclose the use of a screw-type impeller blade in combination with an aerator device. The '685 patent employs a cylindrical helical screw impeller, while the '702 patent incorporates a pair of oppositely oriented continuous spiral screw blades. Similar screw blade configurations are shown in U.S. Pat. Nos. 4,200,597 and 4,230,648.

U.S. Pat. No. 3,975,469 discloses an aerator device for revolving liquids and supplying a gas thereto having at least one continuous spiral screw blade which forms an acute angle to the drive shaft, and further incorporates a foam knife which rotates on the drive shaft at the surface of the water. This patent further describes other commercial uses for aerator devices such as precipitating divalent iron from water by oxidation to trivalent iron, or removing carbonic acid from steam boiler water by aeration.

U.S. Pat. No. 3,778,233 discloses an apparatus for liquid composting of animal wastes which is designed to be used in the reservoir situated below the flooring of a livestock confinement building. The aerator disclosed in the '233 patent is similar in design and operation to that of the above mentioned '990 patent, however the '223 patent provides for an elongated stabilizing cylinder surrounding the drive shaft.

As one alternative, U.S. Pat. No. 3,606,273 shows an aerator which may be floated on the surface of the pond, with the impeller shaft extending vertically downward below the water. The '273 patent discloses an improved deflection bearing, deflector hub, and propeller blades mounted to the shaft and situated within the housing, with the propeller blades and lower portion of the housing remaining below the surface of the water such that the entire housing acts as the conduit through which the air is injected.

Other methods exist for mixing gases with a liquid being stirred, agitated, or transferred. Devices for performing these tasks on a smaller scale are commonly found in chemical or biological laboratory settings. The simplest method is to place the liquid in a vessel with a stirring apparatus, and introduce the desired gas into that vessel above the liquid to form a gas-liquid interface. Another similar method is to bubble the gas through the liquid, or pass the liquid through a gas filter or over a gas transfer surface. One can thus rely upon the natural rate of gas transfer, which depends upon the chemical properties of the gas and liquid, the surface area of the transfer, the diffusion rate and the agitation of the liquid, the effect of the temperature of the liquid on gas solubility, and so forth. One can also stir the liquid to produce such a high angular velocity that a downward syphon or jet is formed on the surface of the liquid, which in turn draws gas from above the gas-fluid interface. Such methods are enhanced by cooling the liquid and increasing the pressure of the volume of gas above the gas-fluid interface by several atmospheres.

One apparatus representative of these methods of mixing gases and liquids in a laboratory or chemical engineering setting is shown in U.S. Pat. No. 4,267,052. The '052 patent discloses a mixing vessel having a hollow, motor driven stirring rotor which draws gas and liquid into its center by a venturi effect, and injects the liquid and gas mixture through the bottom of the rotor. Gas is also transferred to the liquid at the gas-liquid interface.

The aerator devices described above do possess several common deficiencies or limitations. The devices rely solely upon a venturi principle to draw air into a hollow tube or conduit and transport that air to a point below the surface of the water. While the air may either be mixed with the water within the conduit or near the point of injection or agitation at the distal end of the conduit, the air is drawn into the conduit from a source which remains at a relatively constant atmospheric pressure. Due to the vacuum created by the moving water or air responsible for the venturi effect, the air being injected into the water at the distal end of the aerator is generally at a pressure much less than that atmospheric pressure.

The devices each rely upon some type of propeller or impeller for agitating the water. The angle, shape, number, size, and rotational relationship of the blades on those propellers are the factors primarily responsible for determining the degree of agitation or turbulence imparted to the water, and the rate at which a uniform volume of water may be passed through the zone of air injection and mixing. While some aerators are shown having baffles or plates against which the aerated water may be directed to disrupt the bubbles into finer, more discrete bubbles, these baffles or plates create a static pressure adjacent to the zone of air injection which interferes with the maximum flow rate of the water along its longitudinal path through the zone of air injection.

BRIEF SUMMARY OF THE INVENTION

It is therefore one object of this invention to design a waste water aerator in which the supply of air drawn into the conduit by venturi action is maintained at greater than atmospheric pressure.

It is a related object of this invention to design the above aerator such that said air being supplied to the distal end of the aerator for injection into the water is at an increased pressure than would be achieved merely by drawing air at atmospheric pressure through the use of a venturi.

It is another object of this invention to design the above aerator such that the means for maintaining the air drawn into the conduit at a pressure greater than atmospheric pressure is integrally related within and mechanically coupled to the drive means of the aerator.

It is a further object of this invention to design the above aerator such that a conventional shaft driven propeller or impeller may be used, and such that the means for maintaining the air at an increased pressure when injected into the water is an integral component of the aerator mechanically coupled to the drive means.

It is still another object of this invention to design the above aerator such that the agitation induced by any given propeller or impeller may be enhanced and augmented by creating turbulence within the water prior to contact with the propeller or impeller blades, and by imparting a velocity to the water different from that induced by the propeller or impeller.

It is a related object of this invention to design the above aerator such that independent shear forces may be created within the water being agitated surrounding the zone of air injection so as to provide additional turbulence.

It is a similarly related object of this invention to design the above aerator such that the flowing water may be given the specified velocity and subjected to independent shear forces without creating static pressure in the water adjacent or subsequent to the water passing through the zone or air injection.

Described briefly, the aerator of this invention is comprised of a housing, a motor driven cylindrical tube having an open distal end extending through the housing, and propeller blades attached to the distal end of the cylindrical tube. The surrounding ambient air enters the housing and is compressed by pairs of opposing compression blades located therein, with the compressed air being drawn through inlet slots into a central conduit formed by the cylindrical tube, and injected into the water through the open distal end thereof. The aerator may also be equipped with optional feed vanes to direct the compressed air through the inlet slots, and fixed fins to redirect the flow of the water past the propeller blades.

DESCRIPTION OF THE PREFERRED EMBODIMENTS

The aerator of this invention is shown in FIGS. 1–8 and referenced generally therein by the numeral 10.

Figure 1:
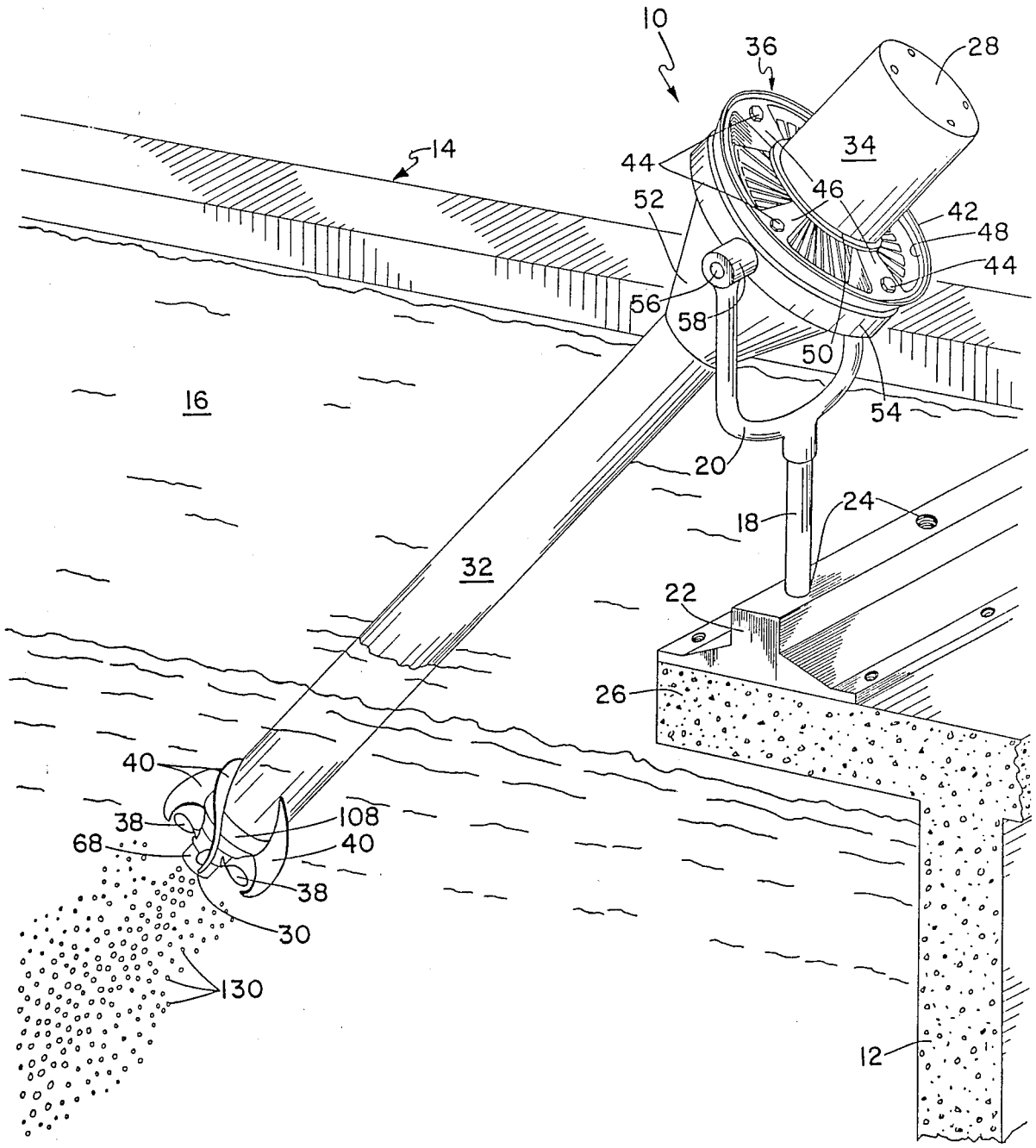
FIG. 1 is a perspective view of the aerator of this invention mounted in operational position on the retaining wall of a reservoir.

Referring to FIG. 1, the aerator 10 is seen mounted on a retaining wall 12 surrounding a reservoir 14 of liquid 16. The reservoir 14 may comprise any of a variety of sewage or waste water treatment facilities, settling ponds, or composting tanks. The waste water 16 or other component materials contained in the reservoir 14 may be comprised of a combination of liquids and solids, the constitution of which may range from a thin fluid to a viscous sludge, provided that any miscible semi-fluids will conform to certain flow characteristics when agitated.

In the particular mounting arrangement shown in FIG. 1, the aerator 10 is supported on a pedestal base 18 within a Y-shaped yoke 20. The pedestal 18 is mounted on a linear beam 22 fixed within one of several spaced apart, threaded apertures 24. The linear beam 22 is anchored to the horizontal top ledge 26 of the retaining wall 12. The aerator 10 is suspended such that its proximal end 28 is above the surface of the water 16, whereas the distal end 30 projects below the surface of the water 16. It is understood that the aerator 10 may be mounted by any one of a number of known mounting arrangements, in an angled position as shown in FIG. 1 or in a generally vertical position, to the extent that the proximal end 28 is maintained above the surface of the water 16 and the distal end 30 is submerged when the aerator 10 is in normal operation.

Continuing with reference to FIG. 1, the aerator 10 can be seen to comprise an elongated, generally cylindrical housing 32, a motor 34 and associated mounting frame 36 located near the proximal end 28 of the arator, and a propeller 38 and helical control fins 40 at the distal end 30 of the aerator.

Figure 2:
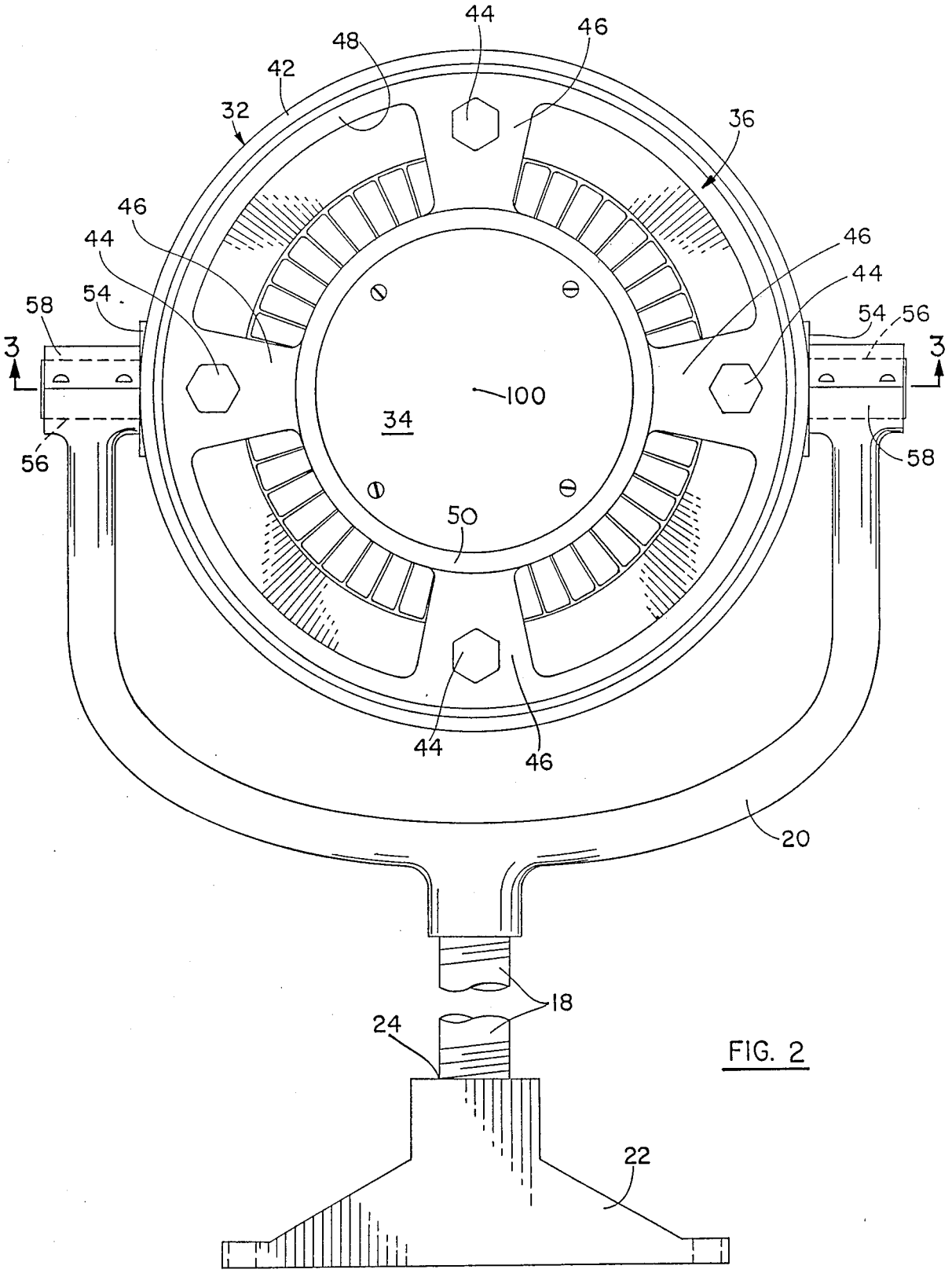
FIG. 2 is an upper end view of the aerator of FIG. 1.
Figure 3:
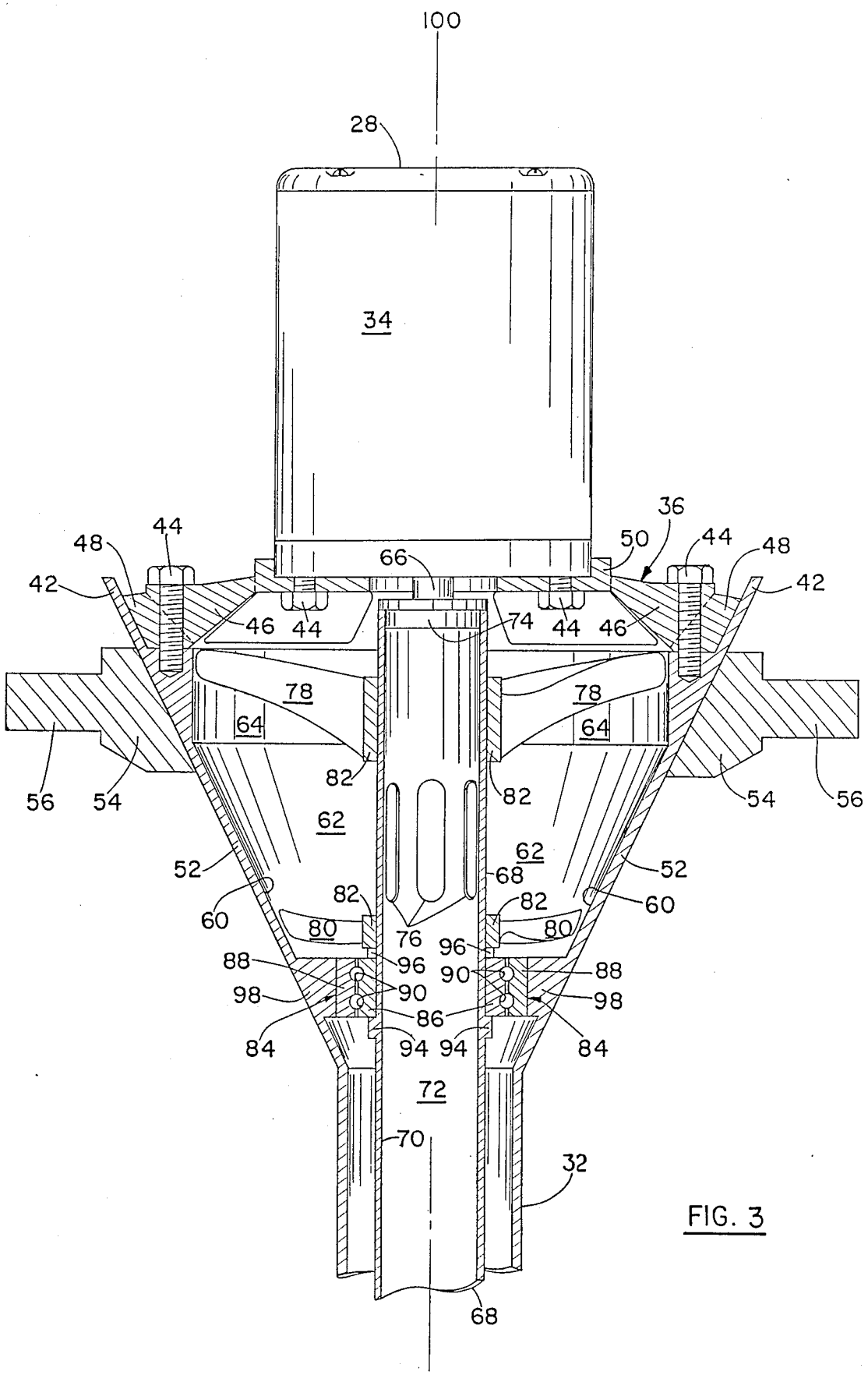
FIG. 3 is a cross sectional bottom view of the power drive end of the aerator of FIG. 1 taken through cutting plane 3—3 in FIG. 2.

As seen in FIGS. 2 and 3, the motor mounting frame 36 has a generally circular shape and is slidably received within the rear end 42 of the elongated housing 32 and fastened thereto using four hex bolts 44. The motor mounting frame 36 includes four radial spokes 46 linking a circular outer rim 48 to a circular inner rim 50. The rear end 42 of the elongated, generally cylindrical housing 32 is flared outwardly to form a generally funnel shaped region 52 of the housing 32. This funnel shaped region 52 is surrounded by an internally beveled, annular collar 54, from which a pair of opposing swivel pins 56 project outwardly. These swivel pins 56 are slidably received within mounting sleeves 58 at the ends of the Y-shaped yoke 20. The aerator 10 may thus be supported and pivoted in a vertical plane by rotating the pins 56 within the mounting sleeves 58.

Referring particularly to FIG. 3, it can be seen that the interior surface 60 of the funnel shaped portion 52 of the housing 32 defines a sloping, beveled interior region 62 and a cylindrical interior region 64. Extending into the interior of the housing 32 and mechanically connected to the motor 34 is a drive shaft 66, which in turn is rigidly connected to a hollow, cylindrical tube 68. The tube 68 defines an internal bore 70 which forms a longitudinal conduit 72 extending through the cylindrical tube 68 and continuously through the housing 32 from the rear end 42 of the housing 32 to the distal end 30 of the aerator 10. The proximal end of the cylindrical tube 68 is connected to the drive shaft 66 by a cap 74 which is received within the cylindrical tube 68 and forms an air tight seal therewith.

The cylindrical tube 68 also defines a plurality of air inlet slots 76 of generally oval or elliptical shape, and which extend entirely through the surface of the cylindrical tube 68 and provide a source of fluid communication between the interior regions of the housing 64, 66 and the conduit 72.

Affixed to the outer surface of the cylindrical tube 68 within the interior regions of the housing 64, 66 proximal to the air inlet slots 76 are a pair of first compression blades 78. The first compression blades 78 are mounted on opposing sides of the cylindrical tube 68 and are angled such that the rotation of the cylindrical tube 68 will propel air striking the blades 78 generally parallel to the surface of the cylindrical tube 68 and in a direction generally towards the air inlet slots 76 and distal end 30 of the aerator 10. The first compression blades 78 may be straight or curved, of any shape or design which provides for maximum air flow and compression within the housing 32.

The first compression blades 78 should extend radially outward from the cylindrical tube 68 to a point in close confronting proximity to the interior surface of region 64, and should similarly be placed a minimal distance from the proximal or rear end 42 of the housing 32 as is practicable given the particular method of fastening the circular mounting frame 36 to the housing 32, and providing sufficient clearance between the spokes 46, blades 78, motor 34 and bolts 44 to provide for substantially unrestricted air passage.

A pair of second compression blades 80 are similarly affixed on opposing sides to the outer surface of the cylindrical tube 68 within the interior regions of the housing 64, 66 and nearby the air inlet slots 76. These second compression blades 80 may similarly be straight or curved, of any shape or design which provides for maximum air compression within the housing 32. The first and second compression blades 78, 80 may be attached directly to the cylindrical tube 68, or to annular mounting sleeve 82 surrounding the cylindrical tube 68.

The second compression blades 80 should extend radially outward from the cylindrical tube 68 to a point in close confronting proximity to the interior surface 60 of the housing 32 defining the sloping interior region 62. The second compression blades 80 are angled such that the rotation of the cylindrical tube 68 will propel air striking the blades 80 generally parallel to the surface of the cylindrical tube 68 and in a direction generally towards the air inlet slots 76 and proximal end 28 of the aerator 10, thus directly opposing the flow of air produced by the first compression blades 78.

The first and second compression blades 78, 80 each have a leading face oriented generally toward the angular direction of rotation of the blades 78, 80. It is understood, however, that the faces of the blades 78, 80 may define a curved or contoured surface rather than a purely planar face.

Figure 6:
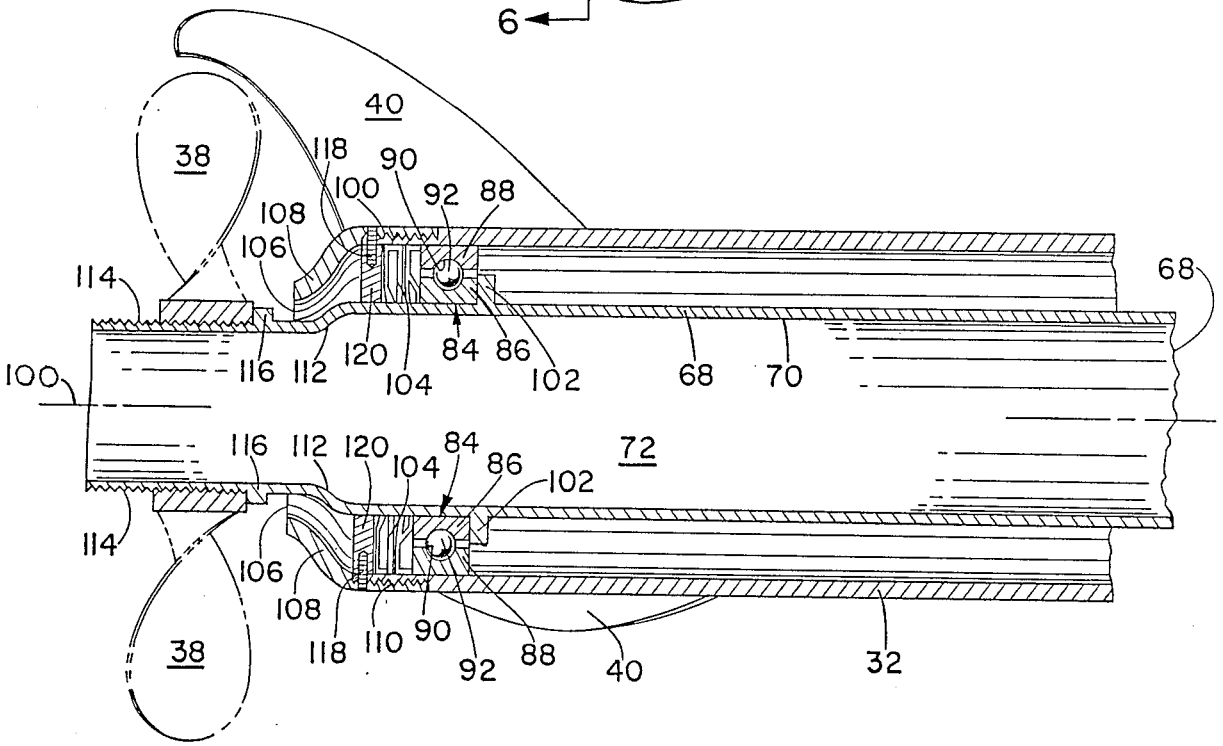
FIG. 6 is a cross section view of the distal end of the aerator of FIG. 1 taken through cutting plane 6—6 in FIG. 5.

Referring to FIGS. 3 and 6, it may be seen that the cylindrical tube 68 is supported in at least two locations near the distal end 30 and the proximal end 28 of the aerator 10 by bearing sleeves 84. The bearing sleeves 84 are of any type well known in the art comprised of an inner annular retaining ring 86 and an outer annular retaining ring 88, each retaining ring 86, 88 being spaced a predetermined distance apart and defining a groove 90 extending into and concentrically along confronting surfaces of each ring 86, 88 such that a plurality of spherical ball bearings 92 may be received within the grooves 90 between the rings 86, 88. These ball bearings 92 permit the annular retaining ring 86 to rotate relative to ring 88 with a minimum of friction.

Referring particularly to FIG. 3, the inner annular ring 86 of the bearing sleeve 84 at the proximal end 28 of the aerator 10 may be attached directly to the outer surface of the cylindrical tube 68, or may be situated between an annular guide projection 94 extending radially outward from the outer surface of the cylindrical tube 68 and a spacing washer 96 surrounding the cylindrical tube adjacent to the mounting sleeves 82 for the second compression blades 80, in order to prevent the bearing sleeve 86 from moving longitudinally with respect to the cylindrical tube 68. The outer annular ring 88 should contact or be affixed to a concentric boss 98 extending radially inward from the interior surface 60 of the beveled interior region 62 of the housing 32, such that the cylindrical tube 68 and corresponding longitudinal axis of rotation 100 may not shift laterally as the cylindrical tube 68 is rotated.

Referring again to FIG. 6, the inner annular ring 86 of the bearing sleeve 84 at the distal end 30 of the aerator 10 may be attached directly to the outer surface of the cylindrical tube 68, or may be situated between an annular guide projection 102 extending radially outward from the outer surface of the cylindrical tube 68 and a backflow compression gasket 104 surrounding the cylindrical tube adjacent to the distal side of the bearing sleeve 82. The backflow compression gasket 104 may be of any type known to the art and suitable for preventing water 16 from flowing through the open end 106 of the housing 32 and upwardly toward the proximal end 28 of the aerator 10 to or past the bearing sleeve 82, while permitting the cylindrical tube 68 to rotate within the gasket 104 at a high angular velocity.

The open end of the housing 106 is fitted with a cylindrical reducer cowl 108 which is threaded onto the outer surface of the housing 32. The reducer cowl 108 has an outer diameter equal to the outer diameter of the cylindrical portion of the housing 32, and the inner surface of the cowl 108 and outer surface of the housing 32 contain corresponding helical threads 110 oriented such that the cowl 108 may be screwed onto the housing 32. The distal end of the cowl 108 has a diameter smaller than that of the cylindrical portion of the housing 32 and larger than the outer diameter of the cylindrical tube 68.

The distal end of the cylindrical tube 68 extends longitudinally outward through the cowl 108, and has a tapered region 112 corresponding to the reduced diameter of the cowl 108. That portion of the cylindrical tube 68 which projects from the housing 32 and cowl 108 is threaded to accept the propeller 38, the threads 114 of the cylindrical tube 68 and propeller 38 being corresponding helical threads 114 oriented such that positive torque may be applied to the cylindrical tube 68 in order to rotate the propeller 38 without the propeller 38 becoming loosened from the cylindrical tube 68. The propeller 38 may be screwed onto the cylindrical tube 68 and tightened into engaging contact with a concentric backstop 116 projecting radially outward from the outer surface of the cylindrical tube 68.

The cowl 108 may be fastened to the housing 32 by a number of threaded screws 118 which extend entirely through the surface of the cowl 108 and housing 32 and are received within an annular alignment collar 120 which surrounds the cylindrical tube 68. This alignment collar 120 may alternately be used to make minor corrections in the orientation and position of the cylindrical tube 68 and longitudinal axis 100 relative to the housing 32 and cowl 108.

Figure 4:
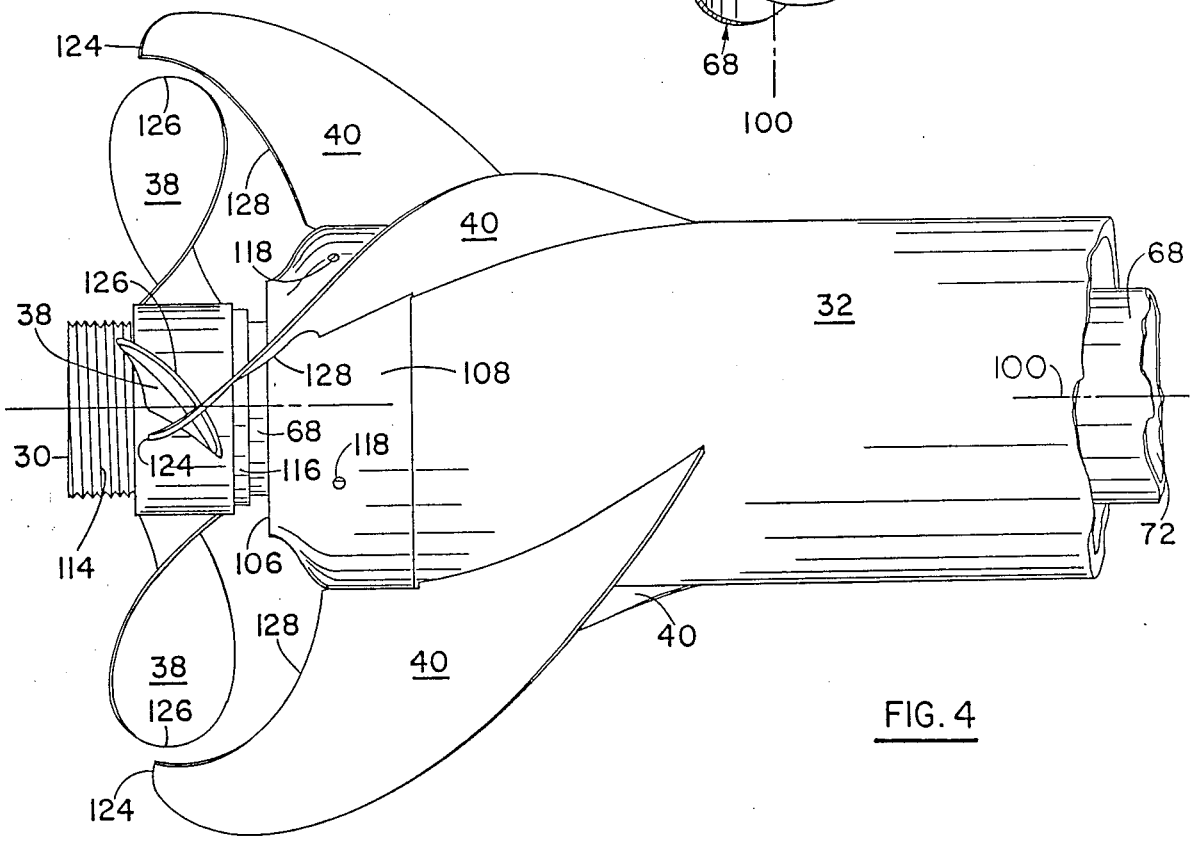
FIG. 4 is a partially cut away side view of the distal or lower end of the aerator of FIG. 1.
Figure 5:
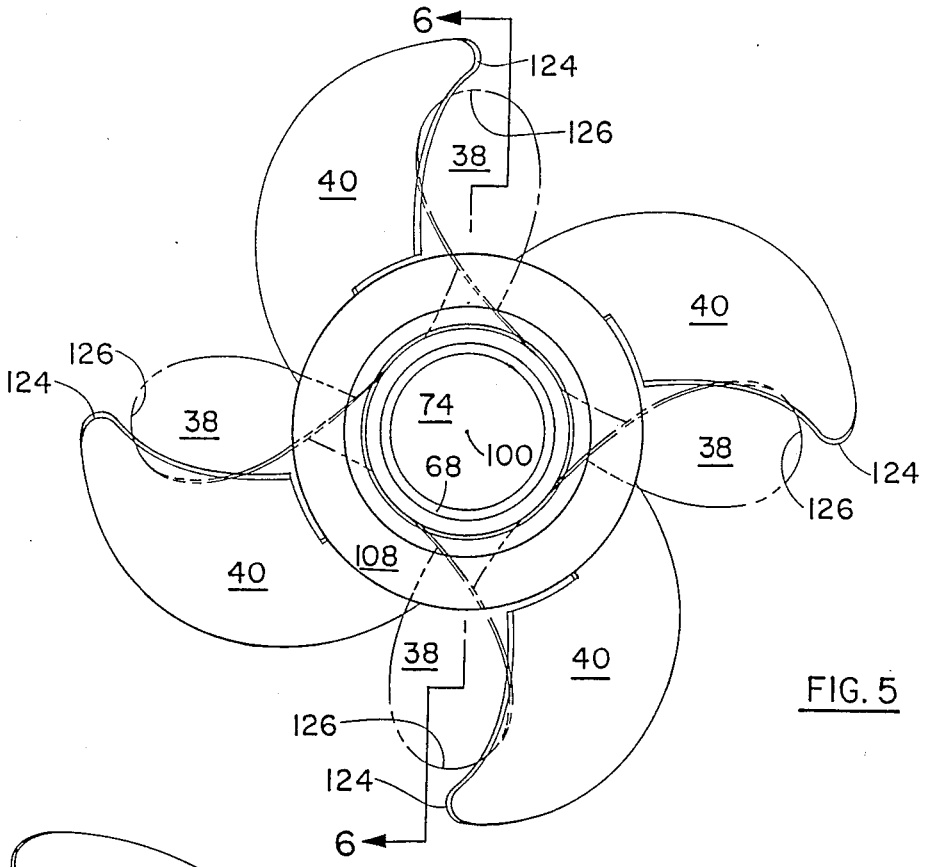
FIG. 5 is a lower end view of the distal end of the aerator of FIG. 1.

Referring to FIGS. 4 and 5, the shape and orientation of the helical control fins 40 and propeller blades 38 may be seen. Four helical control fins 40 are fixedly attached to the cylindrical region of the housing 32 near the distal end 30 of the aerator at 90 degree angles relative to one another circumscribing the housing 32, and each fin 40 slopes radially outward from the housing 32 as it spirals laterally around the housing 32 to a distal tip 124. The distal tip 124 of each fin 40 is oriented approximately 90 degrees angularly relative to the point at which the fin 40 is attached to the housing 32, with each fin 40 spiraling in the same direction around the longitudinal axis 100 clockwise or counterclockwise relative to the housing 32 and in the same angular direction as the propeller blades 38 would normally rotate.

The distal tip 124 of each fin 38 extends longitudinally outward from the housing 32 to a point approximately equal to or beyond the center point 126 of each propeller blade 38 as measured when the propeller blade 38 passes at its closest distance to the distal tip 124 of the fin 40. The inner edge 128 of each fin 38 is arched in a concave manner and extends to a point proximate to the edge of the propeller blade 38 as the rotating propeller blade 38 passes the interior edge 128 of the fixed fin 40.

Figure 8:
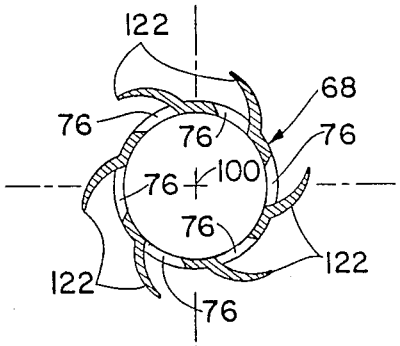
FIG. 8 is a cross sectional view of the drive shaft and feed blades taken through cutting plane 8—8 in FIG. 7.
Figure 7:
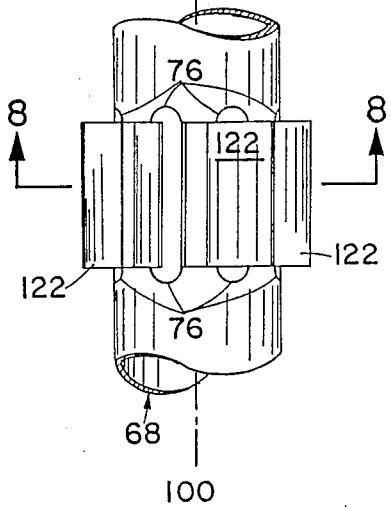
FIG. 7 is a partially cut away view of the drive shaft, inlet slots, and feed blades of a modified embodiment of the aerator.

Referring particularly to FIGS. 7 and 8, a modified embodiment of the aerator 10 is shown, in which the region of the cylindrical tube 68 adjacent to the inlet slots 76 is equipped with a number of feed or scoop vanes 122 which propel compressed air from within the interior regions 62, 64 of the housing 32 through the inlet slots 76 and into the conduit 72 within the cylindrical tube 68. These feed vanes 122 may be formed from a portion of the cylindrical tube 68, or attached as separate components by any suitable fastening means, and define a generally concave surface which is oriented toward and confronting the inlet slots 76 in the direction which the cylindrical tube 68 would normally rotate.

In operation, the aerator 10 is positioned such that the distal end 30 is submerged in the reservoir 14 of waste water 16 with the proximal end 28 situated above the surface of the water 16, and mounted in that position by the means described above.

Power in the form of electrical or mechanical energy is then provided to the motor 34, which will then rotate in a predetermined direction with a controlled angular velocity. The rotation of the motor 34 will in turn cause the cylindrical tube 68, first and second compression blades 78, 80, feed vanes 122, and propeller blades 38 to rotate in the same direction at the same angular velocity.

The rotation of the propeller blades 38 will cause the water 16 to be drawn in a longitudinal path along the exterior surface of the cylindrical portion of the housing 32, and redirected by the fixed fins 40. The propellers 38 and fins 40 will simultaneously cause a significant degree of turbulence and agitation in the water 16, as well as shear forces within the water 16 between the propeller blades 38 and the distal ends 124 and interior edges 128 of the fixed fins 40, due to the rotation of the propeller blades 38 and the fact that the fixed fins 40 will impart a distinct directional velocity to the water 16 independent of that created by the propeller blades 38.

As the water 16 is drawn past the propeller 38 and open distal end of the cylindrical tube 68, a vacuum or venturi force will be created within the conduit 72 by that flowing water 16. Air from within the conduit 72 will be exhausted from the cylindrical tube 68 as it is drawn into and mixed with the agitated water 16 in the form of fine or discrete bubbles 130 by the venturi action.

This vacuum will correspondingly draw air from within the interior regions 62, 64 of the housing through the inlet slots 76 and into the conduit 72. The air which passes into the conduit 72 will be compressed or have a greater density relative to the ambient external air due to the compressive forces of the first and second compression blades 78, 80 and the feed vanes 122.

In this manner, a greater volume of ambient air may be drawn into the aerator 10, compressed, and injected through the distal end 30 into the agitated and turbulent water 16 in the form of many discrete bubbles at an increased rate. The water may then be impacted against plates (not shown) which will further minimize the size of those bubbles, as has previously been explained.

It is further understood that changes and modifications in the design and operation of the above described aerator may be made without departing from the spirit and scope of the invention as set forth below in the following claims.

What is claimed is:

1. In an aerator of the type used for agitating a liquid having a surface and for mixing an ambient gas with said liquid, said aerator having a housing, a shaft and a propeller means connected to said shaft and being rotatable about a longitudinal axis of rotation, and a gas transport conduit having a gas inlet means and a gas outlet means, said aerator being mountable such that said gas inlet means is positioned above said surface of the liquid and the gas outlet means is positioned below the surface of the liquid, the improvement comprising:

Compression means for compressing the ambient gas prior to the gas being admitted to said transport conduit through said inlet means;

said compression means including one or more blade means, said blade means being contained within said housing adjacent said inlet means, said blade means rotatable about said longitudinal axis of rotation; and said blade means comprising:

at least one first compression blade being carried on said shaft between a proximal end thereof and said inlet means such that said first compression blade is rotatable about said longitudinal axis with said shaft, said first compression blade being oriented so as to propel the gas in a direction generally parallel to said shaft toward said inlet means when said first compression blade rotates with said shaft; and at least one second compression blade opposing said first compression blade and being carried on said shaft between a distal end thereof and said inlet means such that said second compression blade is rotatable about said longitudinal axis with said shaft, said second compression blade being oriented so as to propel the gas in a direction generally parallel to said shaft toward said inlet means when said second compression blade rotates with said shaft.

2. In an aerator of the type used for agitating a liquid having a surface and for mixing an ambient gas with said liquid, said aerator having a housing, a hollow air supply shaft and a propeller means connected to said shaft being rotatable about a longitudinal axis of rotation, and wherein the propeller means draws water along said housing toward the distal end of the aerator in a generally longitudinal flow path, said aerator being mountable such that said distal end is positioned below said surface of said liquid, the improvement comprising:

one or more helical fins, said helical fins being fixedly connected to the housing adjacent the propeller means and extending radially outward therefrom, said helical fins being positioned on the opposing side of the propeller means from a distal end of the aerator, such that said helical fins contact the liquid drawn along the housing toward the propeller and redirect the generally longitudinal flow path of the liquid prior to the liquid impinging upon the propeller means.

3. The aerator of claim 2 wherein each of the helical fins forms a lateral spiral around the housing as the helical fin extends towards and terminates in a distal tip.

4. The aerator of claim 3 wherein the distal tip of each helical fin is oriented approximately at a ninety degree angle relative to the position at which the helical fin is fixedly connected to the housing.

5. The aerator of claim 3 wherein the propeller means is rotated in a given angular direction, and wherein the helical fins also spiral toward the distal tips thereof in said given angular direction.

6. The aerator of claim 3 wherein the propeller means comprises one or more propeller blade members, each propeller blade member being rotatable in a substantially circular path, with each propeller blade member having an outer edge which circumscribes a substantially circular perimeter path as said blade rotates about the longitudinal axis, and wherein the distal tip of the helical fins extend to a longitudinal and radial position closely adjacent to said substantially circular perimeter path.

7. An aerator for use in agitating a liquid having a surface and for mixing an ambient gas with said liquid, said aerator comprising:

an elongated shaft defining a longitudinal bore extending within said shaft, said shaft having a proximal end and a distal end, and said shaft being rotatable about a longitudinal axis of rotation;

rotational drive means coupled to said shaft adjacent said proximal end for rotating said shaft about said longitudinal axis of rotation;

inlet means adjacent said proximal end of said shaft for admitting gas into said longitudinal bore, said inlet means extending in fluid communication between an exterior region surrounding said proximal end of said shaft and said longitudinal bore;

outlet means adjacent said distal end of said shaft for exhausting the gas from said longitudinal bore, said outlet means extending in fluid communication between an exterior region surrounding said distal end of said shaft and said longitudinal bore;

propeller means for agitating the liquid and fixedly mountable on said shaft adjacent said distal end thereof and rotatable therewith about said longitudinal axis of rotation;

a housing surrounding said proximal end of said shaft adjacent to and encompassing said inlet means;

compression means for compressing the gas in said exterior region surrounding said proximal end of said shaft before the gas is admitted through said inlet means into said bore, said compression means including:

at least one first compression blade being carried on the shaft between the proximal end thereof and the inlet means such that said first compression blade is rotatable about said longitudinal axis with said shaft, said first compression blade being contained within said housing, said first compression blade being oriented so as to propel the gas in a direction generally parallel to said shaft toward said inlet means when said first compression blade rotates with said shaft; and at least one second compression blade opposing said first compression blade and being carried on said shaft between said distal end thereof and said inlet means such that said second compression blade is rotatable about said longitudinal axis with said shaft, said second compression blade being contained within said housing, said second compression blade being oriented so as to propel the gas in a direction generally parallel to said shaft toward said inlet means when said second compression blade rotates with said shaft; and mounting means for mounting the aerator such that said propeller means and said outlet means are positioned below the surface of the liquid, and such that said inlet means is positioned above the surface of the liquid, whereby the gas may be compressed by said compression means, admitted to said proximal end of said bore through said inlet means, and exhausted from said distal end of said bore throgh said outlet means.

8. The aerator of claim 7 wherein said propeller means draws water along said housing toward the distal end of said shaft in a generally longitudinal flow path, said aerator further including one or more helical fins, said helical fins being fixedly connected to said housing adjacent said propeller means and extending radially outward therefrom, said helical fins being positioned on the opposing side of said propeller means from said distal end of said shaft, such that said helical fins contact the liquid drawn along said housing toward said propeller means and redirect the generally longitudinal flow path of the liquid prior to the liquid impinging upon said propeller means.

9. The aerator of claim 8 wherein the number of helical fins is four, each said helical fin being attached to the housing at positions approximately ninety degrees apart from one another circumscribing said housing.

10. The aerator of claim 8 wherein each of said helical fins forms a lateral spiral around said housing as it extends towards and terminates in a distal tip, said distal tip of each said helical fin being oriented approximately at a ninety degree angle relative to the position at which said helical fin is fixedly connected to said housing.

11. The aerator of claim 10 wherein said shaft and said propeller means are rotated in a given angular direction, and wherein said helical fins also spiral toward said distal tips thereof in said given angular direction.

12. The aerator of claim 10 wherein said propeller means comprises one or more propeller blade members, each said propeller blade member being rotatable in a substantially circular path, with each said propeller blade member having an outer edge which circumscribes a substantially circular perimeter path as said blade rotates about the longitudinal axis, and wherein the distal tips of the helical fins extend to a longitudinal and radial position closely adjacent to said substantially circular perimeter path.

13. An aerator for use in agitating a liquid having a surface and for mixing an ambient gas with said liquid, said aerator comprising:

an elongated shaft defining a longitudinal bore extending within said shaft, said shaft having a proximal end and a distal end, and said shaft being rotatable about a longitudinal axis of rotation;

rotational drive means coupled to said shaft adjacent said proximal end for rotating said shaft about said longitudinal axis of rotation;

inlet means adjacent said proximal end of said shaft for admitting the gas into said longitudinal bore, said inlet means extending in fluid communication between an exterior region surrounding said proximal end of said shaft and said longitudinal bore;

outlet means adjacent said distal end of said shaft for exhausting the gas from said longitudinal bore, said outlet means extending in fluid communication between an exterior region surrounding said distal end of said shaft and said longitudinal bore;

propeller means for agitating the liquid and fixedly mountable on said shaft adjacent said distal end thereof and rotatable therewith about said longitudinal axis of rotation, said propeller means drawing water along said housing toward said distal end of said shaft in a generally longitudinal flow path;

a housing surrounding said proximal end of said shaft adjacent to and encompassing said inlet means;

compression means for compressing the gas in said exterior region surrounding said proximal end of said shaft before the gas is admitted through said inlet means into said bore;

mounting means for mounting the aerator such that said propeller means and said outlet means are positioned below the surface of the liquid, and such that said inlet means is positioned above the surface of the liquid, whereby the gas may be compressed by said compression means, admitted to said proximal end of said bore through said inlet means, and exhausted from said distal end of said bore through said outlet means; and the aerator further including one or more helical fins, said helical fins being fixedly connected to said housing adjacent said propeller means and extending radially outward therefrom, said helical fins being positioned on the opposing side of said propeller means from said distal end of the shaft, such that said helical fins contact the liquid drawn along said housing toward said propeller means and redirect the generally longitudinal flow path of the liquid prior to the liquid impinging upon said propeller means.

14. The aerator of claim 13 wherein the number of helical fins is four, each said helical fin being attached to the housing at a position approximately a ninety degree angle relative to one another circumscribing the housing.

15. The aerator of claim 13 wherein each of the helical fins forms a lateral spiral around the housing as it extends towards and terminates in a distal tip, said distal tip of each helical fin being oriented approximately at a ninety degree angle relative to the position at which the helical fin is fixedly connected to the housing.

16. The aerator of claim 15 wherein the shaft and propeller means are rotated in a given angular direction, and wherein the helical fins also spiral toward the distal tips thereof in said given angular direction.

17. The aerator of claim 15 wherein the propeller means comprises one or more propeller blade members, each propeller blade member being rotatable in a substantially circular path, with each propeller blade member having an outer edge which circumscribes a substantially circular perimeter path as said blade rotates about the longitudinal axis, and wherein the distal tips of the helical fins extend to a longitudinal and radial position closely adjacent to said substantially circular perimeter path.

* * * * *